United States Patent [19]

Best et al.

[11] 4,451,092

[45] * May 29, 1984

[54] CUTTING ROLLER

[75] Inventors: Gerd Best, Sprockhövel; Norbert B. Weikert, Dortmund, both of Fed. Rep. of Germany

[73] Assignee: Krampe & Co Fertigung in Bergbaubedarf GmbH, Hamm, Fed. Rep. of Germany

[ * ] Notice: The portion of the term of this patent subsequent to Feb. 10, 1998 has been disclaimed.

[21] Appl. No.: 340,725

[22] Filed: Jan. 19, 1982

[30] Foreign Application Priority Data

May 26, 1981 [GB] United Kingdom ..... 8116046

[51] Int. Cl.³ ..... E21C 25/10

[52] U.S. Cl. ..... 299/81; 299/87

[58] Field of Search ..... 299/81, 87

[56] References Cited

U.S. PATENT DOCUMENTS 4,249,779 2/1981 Best et al. ..... 299/81

4,358,161 11/1982 Needham ..... 299/87

*Primary Examiner*—Ernest R. Purser

*Attorney, Agent, or Firm*—Michael J. Striker

[57] ABSTRACT

A cutting roller for a mining machine, having a substantially conical closure member arranged to face the workings and a tubular body member which has a larger diameter at the end nearer the working face than at the discharge end. The tubular member carries at least one cutting blade, and the closure member mounts at least one cutting blade; each blade is provided at its edge region with a plurality of bit holders for the attachment of cutter bits. The outer surface of the body member merges into the substantially conical closure member in a smooth, even curve, so that the outside diameter of the body member in the region of the working face is substantially greater than the diameter in the region of the discharge end of the cutting roller. The roller is provided with liquid distribution channels on each cutting blade, which channels are connected to a single liquid distribution ring channel in the region of the substantially conical closure member.

11 Claims, 3 Drawing Figures

CUTTING ROLLER

BACKGROUND OF THE INVENTION

This invention relates to a cutting roller for a mining machine.

The prior art includes so-called single and multiple cutting rollers for mining machines used in underground mining, particularly for use in coal mining. Cutting rollers of this kind usually consist of a cylindrical tubular housing or body, the so-called tube member, on which one or more cutting blades is or are welded so as to extend helically about the tubular housing. Welded on to the outside of the blades at regular intervals are bit holders in which cutter bits are mounted. The end of the cutting roller facing towards the face of the workings is closed off by an end plate.

Cutting rollers of this kind are also known wherein the cutting rollers are provided with a so-called conical closure ring, also known as a conical closure member. This closure ring is fixedly connected to the end plate by welding. The conical closure member is also provided at regular intervals around its outer edge, projecting towards the face of the workings, with bit holders in which cutter bits are mounted, these bits consequently projecting substantially beyond the outer edge region of the conical closure ring towards the face of the workings. As a result of this conical configuration of the closure ring, frictional engagement between the cutting roller and the face of the workings is reduced. Consequently, better efficiency and less dust formation are obtained during the cutting operation.

In this connection, it is known that any deviation of the end plate from the radial arrangement results in an improvement. It has already been recognized that the cone angle, i.e. the angle between any line drawn radially along the end plate and the axis of the cutting roller, which is less than 90 degrees results in certain advantages. Cone angles of between 30 and 85 degrees are conventionally used. The preferred range of cone angles is from about 50 to 70 degrees. Favorable results are also obtained with a cone angle of about 60 degrees.

However, in the known cutting rollers, the supply of spraying water often presents problems.

Moreover, the drive power required for the known cutting rollers with a conical closure ring and cylindrical body member is considerable.

SUMMARY OF THE INVENTION

It is therefore an object of the present invention to avoid the disadvantages found in the prior art cutting rollers utilized in mining machines.

More particularly, the object of the invention is to provide an improved cutting roller which is very efficient in operation.

A cutting roller for a mining machine, according to the invention, has a substantially conical closure member arranged to face the workings and a tubular body member which has a larger diameter at the end nearer the working face than at the discharge end, said tubular member mounting at least one cutting blade, the closure member mounting at least one cutting blade, each blade being provided at its edge region with a plurality of bit holders for the attachment of cutter bits, wherein the outer surface of the body member merges into said substantially conical closure member in a smooth, even curve (without any steps), so that the outside diameter of the body member in the region of the working face is substantially greater than the diameter in the region of the discharge end of the cutting roller.

The objects of the invention are further attained by liquid distribution channels on each cutting blade of the tubular member and the substantially conical closure member, which channels are connected to a single liquid distribution ring channel provided in the region of the substantially conical closure member.

Owing to the fact that the body member of the cutting roller and the closure ring merge smoothly with each other, first of all this protects the mineral mined, since there is no longer a kind of jumping effect between the substantially conical closure ring and the cylindrical or conical body member of the prior art, thereby undesirably increasing the proportion of fine material and dust, which is a disadvantage, particularly in the mining of coal.

The special configuration of the cutting roller on its outer surface ensures that the mineral mined is conveyed gently from the face of the workings to the discharge end.

The current used by the drive motor for a cutting roller of this construction is appreciably less than is used by a cutting roller having, for example, a cylindrical body member with a conical closure ring. For example, the current required for a cutting roller according to the invention may be reduced by more than ten percent in relation to a comparable cutting roller of the prior art.

Owing to the fact that all the blades and the substantially conical closure ring are supplied with spraying liquid by means of a single central common liquid distribution channel arranged in the region of the substantially conical closure ring, a simple construction is obtained. In a cutting roller according to the invention, the number of blades is no longer of any importance in the supply of spraying liquid, since a single-thread cutting roller will be supplied with spraying liquid from the central water channel in the same way as a multi-thread cutting roller, e.g. a roller with three blades arranged offset from one another over the periphery at intervals of 120 degrees. In this case, for example, it is merely necessary to provide connecting bores or connecting ports in the regions in which the blades cover the central liquid channel, and consequently it is advisable to mount the central liquid distribution channel at an axial spacing from that end of the substantially conical closure ring, which is nearer to the face of the workings.

Preferably the outer surface of the tubular body member extends in an exponential curve with an exponent greater than 2. With this feature a particularly advantageous construction is obtained. In this case, the outer surface of the cutting roller extends, in the region of the end closer to the working face and facing the closure ring, with a greater curvature than towards its discharge end, where the outer surface is directed, at its outermost, discharge end, substantially asymptotically relative to the longitudinal axis (central axis) of the cutting roller. Consequently, there is the further advantage that, in the region of the discharge end of the cutting roller, the outer surface can be formed so that the cutting roller or parts thereof are easy to cast, since the exponential curvature, which is still only slight in the region of the discharge end of the cutting roller, produces a tapered form for the outer surface in the region of the discharge end of the cutting roller relative to the longitudinal axis thereof, thus making it easy to remove the halves of the cutting roller or an entire cutting roller from the mould after the casting operation.

Preferably the outer surface of the tubular body member is composed, at least over a considerable part of its axial length in the region of the working face, of a number of adjacent arcs with different radii, which merge with one another as smoothly as possible.

Preferably the outer surface of the tubular body member tapers gradually and substantially asymptotically, viewed in relation to the longitudinal axis, starting at the end nearest the working face, from a larger diameter down to a smaller diameter at the discharge end, so that in the region of the working face said outer surface extends substantially conically or in a wedge-shaped arrangement relative to the central longitudinal axis of the cutting roller. This feature is also advantageous with regard to the casting operation, since it is easier to remove the roller from the mould.

Preferably in the region of the substantially conical closure member the distribution ring channel is formed by a groove which initially opens outwards and extends coaxially with respect to the longitudinal axis of the cutting roller, this groove being outwardly sealed off in water tight manner by means of a sheet metal member welded thereto, the distribution ring channel being connected by means of a radially extending bore, or several such bores, to a spraying liquid feed line, or several such lines, extending inside the tubular body member, whilst each of the cutting blades is connected to the distribution ring channel in outwardly water tight manner but so as to be capable of conveying spraying liquid, this connection being provided by means of a connecting channel in the region where the blade crosses the distribution ring channel. This results in a particularly unimpeded flow of the mine mineral towards the discharge end of the cutting roller, in conjunction with a small proportion of fine material and correspondingly little dust formation, all of which is particularly advantageous for use in underground coal mining.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
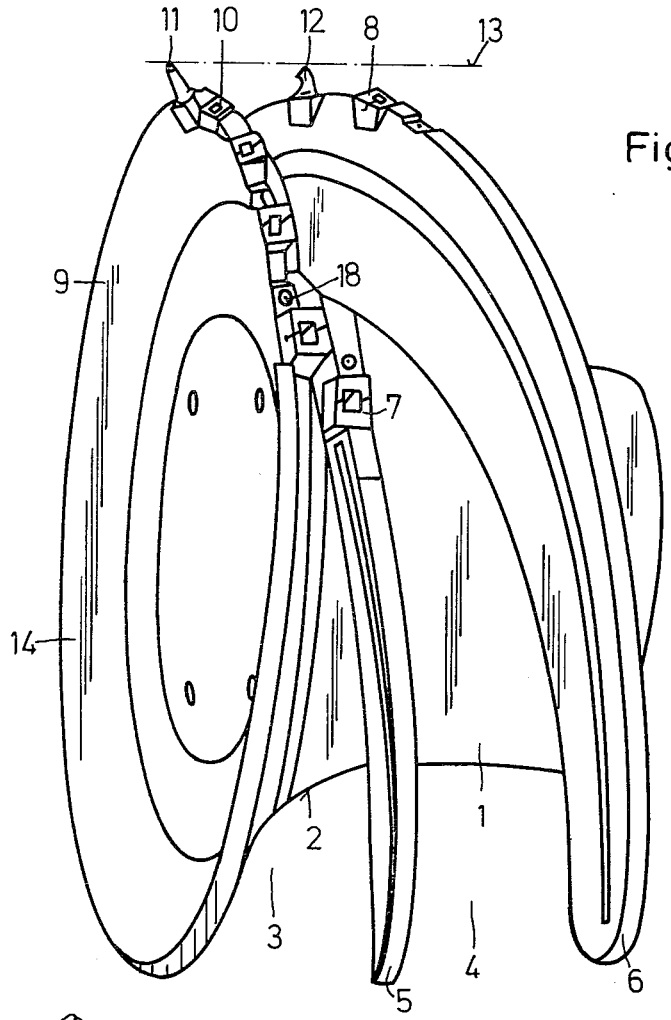
FIG. 1 is a perspective view of a cutting roller according to the invention.

In the drawings, the invention is illustrated with reference to a cutting roller which may advantageously be used particularly in underground coal mining.

Reference numeral 1 denotes a tubular body member which is constructed so as to extend in a curve over its outer surface 2, and over its entire length, this curve being, for example, an exponential curve with an exponent greater than 2.

Figure 2:
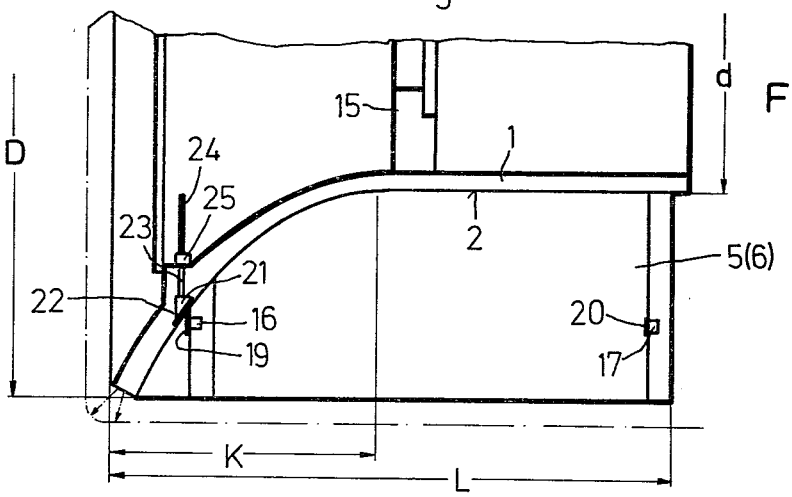
FIG. 2 is a partial longitudinal section through the roller shown in FIG. 1.

The configuration of such curve is clearly seen in FIG. 2. The arrangement is such that, in the region of the face of the workings (not shown), the external diameter D of the tubular member is greatest, whilst the smallest external diameter d is at the discharge end of the tubular member 1. As can be seen from FIG. 2, in particular, in the region of the end of the tubular member 1 nearest the face of the workings, the largest external diameter D decreases rapidly, for example hyperbolically, until the smallest external diameter d is reached. This very rapid decrease in the maximum external diameter D occurs, in the embodiment shown (FIG. 2), over a part K which is about one-third of the total length L of the tubular member 1, measured from the end of the tubular member nearest the face of the workings. Over the remaining length of the tubular member 1 the reduction in the external diameter down to the smallest external diameter d occurs only gradually in the embodiment shown. Under the operating conditions assumed, the reason for the arrangement shown is that the quantity of a mineral mined does not vary as much as over the length K, and consequently the cross sections of discharge (cross sections of conveying) 3 and 4 between outwardly projecting blades, coils, or vanes 5 and 6 mounted in a helical configuration on the tubular member 1 do not need to increase in size as rapidly as in the region of the face of the workings.

With reference to FIG. 1 it is seen that blades (coils or vanes) 5 and 6 are provided on the surface of the tubular member 1. Blades 5 and 6 consist of sheet metal members welded edgewise to the tubular member 1. Each blade 5 or 6 is provided, on its outer periphery, with bit holders 7 or 8 arranged at regular intervals and fixedly, i.e. integrally, connected to the associated blade, coil or vane 5 or 6 by means of weld seams.

At the end of the tubular member 1 nearest the face of the workings, there is a closure member or closure ring 9 which opens substantially conically towards the face of the workings and is formed integrally with the tubular member 1. The substantially conical closure member 9 also has bit holders 10 distributed around its outer periphery like the blades of coils 5 or 6. All the bit holders 7, 8 and 10 are fitted with outwardly protruding bits 11, 12 which cut into the mineral (although in the drawings only two bits 11 and 12 are shown). The tips of all the bits 11 and 12 lie on an imaginary cylindrical envelope 13. The outer edges of the blades 5 and 6 and of the substantially conical closure member 9 also lie on a common cylindrical envelope (not shown) in a manner similar to that of bits 11, 12.

Reference numeral 14 designates a cover, whilst 15 (FIG. 2) designates an attachment flange for a motor drive (not shown) for the cutting roller.

Referring back to FIG. 2, reference numerals 16 and 17 denote channels for spraying liquid, through which water, for example, is supplied to spray nozzles 18 for damping down the dust, only the spray nozzle 18 being shown in FIG. 1, in the interests of clarity. The spraying liquid channels 16 and 17 are produced by forming grooves in the walls on the leeward side (the side of the blades facing opposite from the direction of conveying); these grooves are then covered with sheet metal members 19 and 20.

In the embodiment shown, the tubular member 1 with the spraying liquid channels 16 and 17 is produced by casting. The ring member 9 and the attached flange 15 can readily be cast integrally therewith from the same material. All the other connecting ports for spray liquid and the like, which are not shown in the interests of simplicity, may also be formed therein. Therefore, it is no longer necessary, for example, to form the substantially conical closure member 9 as a separate component.

Moreover, the cutting roller in this embodiment may be in two parts or in one part; i.e. two half shells produced as castings may be suitably joined together, for example, whilst the blades 5 and 6 may be formed, for example, by welding, or casting, or partially casting blades 5 and 6 thereon. Instead or additionally, in the case of a two-part construction of the cutting roller, the half shells may be joined together by means of flanges (not shown), for example in the form of internal flanges, using screws or the like.

As is clearly shown in FIG. 2, in the region of the spraying liquid channel 16 and in the region of the end of the cutting roller nearest the face of the workings, i.e. in the region of the substantially conical ring member 9, a liquid distribution ring channel 21 extending coaxially relative to the axis of the cutting roller is provided, which is produced by milling a suitable groove and is sealed off outwardly in water tight manner by means of a sheet metal member 22 welded thereon. The distribution ring channel 21 is connected to a feed line 24 by means of a radial bore 23 or several such bores, said feed line 24 extending inside the tubular member 1 and being connected to a suitable source of spraying liquid.

Reference number 25 denotes a suitable cover or a connecting fitting.

Figure 3:
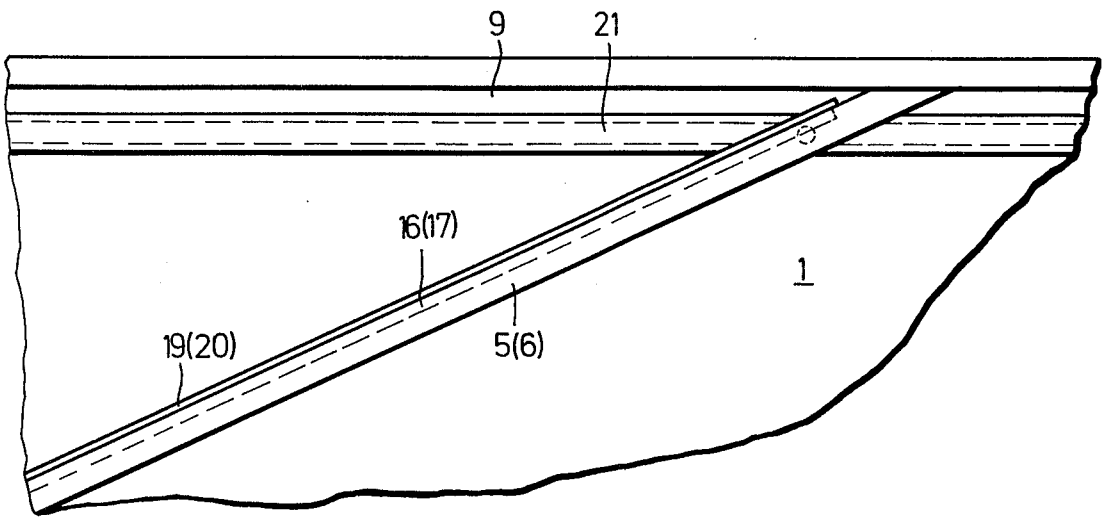
FIG. 3 is a partial development of a cutting roller according to FIG. 1.

As a result, it is possible to supply spraying liquid via the feed line 24 and through the interior of the cutting roller to the radial bore 23 and into the distribution ring channel 21, which is crossed by the two coils 5 and 6 at various points on the periphery, corresponding to their helical path (FIG. 3). In the region of this crossing, a connection is provided between the distribution channel 21 and the spraying liquid channel 16. In this way, it is possible to supply the nozzles of any desired number of coils and additionally the nozzles of the closure ring 9 with spraying liquid, using a single channel 21. For this, the distribution ring channel 21 need only be drilled or the like in the region of the crossing over of the coils, so as to provide a connection between the distribution ring channel 21 and the corresponding spraying liquid channel 16 in the associated coil 5.

In this way, a construction is obtained in which the supply of spraying liquid to the nozzles of the cutting blades and closure member is simplified, whilst giving the cutting roller a basic form which reduces the amount of current required by the drive motor.

It will be understood that each of the elements described above, or two or more together, may also find a useful application in other types of cutting rollers for underground mining different from the types described above.

While the invention has been illustrated and described as embodied in a cutting roller for underground mining, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A cutting roller for a mining machine, comprising a substantially conical member arranged to face the workings; a tubular body member having a central longitudinal axis and an end nearer the workings and a discharge end; at least one cutting blade on said working member; at least one cutting blade on said tubular member, each of said blades being provided with a plurality of bit holders carrying cutter bits, said body member having an outer surface extending over the entire length of the body member towards said closure member in such a smooth and even curve that the outer diameter of the body member in the region of the end nearer the workings is substantially greater than in the region of the discharge end; and means on the cutting roller for distribution liquid for damping dust produced during the mining, said means being connected to a suitable source of spraying liquid, said liquid distribution means including a single liquid distribution ring channel arranged in the region of said closure member and a number of liquid distribution channels on said cutting blades connected thereto, said liquid distribution ring channel being formed by a groove which opens towards and extends coaxially with said longitudinal axis.

2. The cutting roller of claim 1, wherein said curve is an exponential curve with an exponent greater than 2.

3. The cutting roller of claim 1, wherein said outer surface is formed, at least over a considerable part of the length of the body member in the region of the end nearer the workings by a number of adjacent arcs with different radii, said arcs merging with one another as smoothly as possible.

4. The cutting roller of claim 3, wherein the outer surface of the tubular body member tapers gradually and substantially asymptotically, viewed in relation to said longitudinal axis, starting from a larger diameter at the end nearer the workings to a smaller diameter at the discharge end, so that in the region of a working face of the body member said outer surface extends substantially conically relative to the central longitudinal axis of the cutting roller.

5. The cutting roller of claim 4, wherein said groove is outwardly sealed off in water tight manner by means of a sheet metal element rigidly secured to the cutting roller.

6. The cutting roller of claim 5, wherein said sheet metal element is welded to the roller.

7. The cutting roller of claim 5, wherein said liquid distribution means further include at least one liquid feed line connected to said suitable source and extending inside said body member, and at least one radially extending bore interconnecting said feed line with said liquid distribution ring channel.

8. The cutting roller of claim 7, wherein said liquid distribution channels on said cutting blades are connected to said liquid distribution ring channel in an outwardly water tight manner but so as to be capable of conveying spraying liquid, such a connection being provided by means of a connecting channel arranged in the region where the respective blade crosses the liquid distribution ring channel.

9. The cutting roller of claim 8, wherein the shape of the cutting roller in a straight longitudinal section is tulip-like, the roller having its largest central opening located in the region of the working face and the smallest diameter at the discharge end.

10. The cutting roller of claim 8, wherein each of the liquid distribution channel on said cutting blades is terminated with a spraying nozzle.

11. The cutting roller of claim 3, wherein the outer surface of the tubular body member tapers gradually and substantially asymptotically, viewed in relation to said longitudinal axis, starting from a larger diameter at the end nearer the workings to a smaller diameter at the discharge end, so that in the region of a working face of the body member said outer surface extends in a wedge-shaped arrangement relative to the central longitudinal axis of the cutting roller.

* * * * *